United States Patent [19]

Naito et al.

[11] Patent Number: 4,602,141

[45] Date of Patent: Jul. 22, 1986

[54] DEVICE FOR PREVENTING ELECTROMAGNETIC WAVE LEAKAGE FOR USE IN MICROWAVE HEATING APPARATUS

[76] Inventors: Yoshiyuki Naito, 9-29, Tsukimino/Yamato-shi, Kanagawa-Ken, Yamato-shi; Michiharu Takahashi, 390-190, Takazu, Yachiyo-shi, both of Japan

[21] Appl. No.: 764,244

[22] Filed: Aug. 9, 1985

[30] Foreign Application Priority Data

Jun. 7, 1985 [JP] Japan ..... 60-123665

[51] Int. Cl.[4] ..... H05B 6/76

[52] U.S. Cl. ..... 219/10.55 D; 174/35 MS; 343/18 A; 252/62.51

[58] Field of Search ..... 219/10.55 D, 10.55 R; 174/35 MS, 35 GC; 343/18 A; 252/62.51

[56] References Cited

U.S. PATENT DOCUMENTS

| | | | |
|---|---|---|---|
| 3,866,009 | 2/1975 | Ishino et al. | 219/10.55 D |
| 4,012,738 | 3/1977 | Wright | 343/18 A |
| 4,023,174 | 5/1977 | Wright | 343/18 A |
| 4,046,983 | 9/1977 | Ishino et al. | 219/10.55 D |
| 4,371,742 | 2/1983 | Manly | 174/35 MS |
| 4,539,433 | 9/1985 | Ishino et al. | 174/35 MS |

*Primary Examiner*—Philip H. Leung

*Attorney, Agent, or Firm*—Emmanuel J. Lobato; Bruce L. Adams; Robert E. Burns

[57] ABSTRACT

A device for preventing electromagnetic wave leakage from gaps between the body of a microwave heating device and the door thereof. The device is configured using an electromagnetic absorber consisting of a mixture obtained by mixing ferrite powder and carbon powder with a soft binder such as rubber so that the device is easily attached on the opening portion of the heating apparatus body or the surface of the door.

4 Claims, 14 Drawing Figures

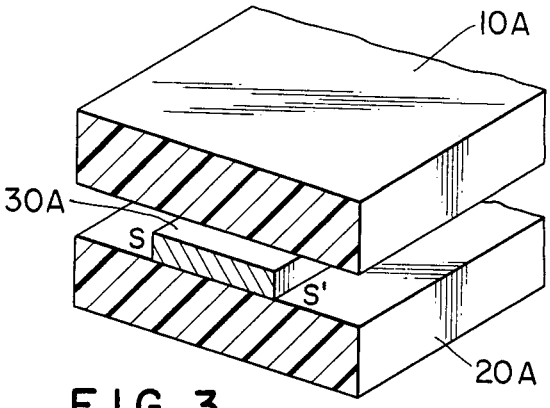
FIG. 3
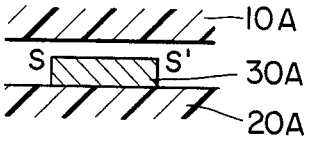
FIG. 3a
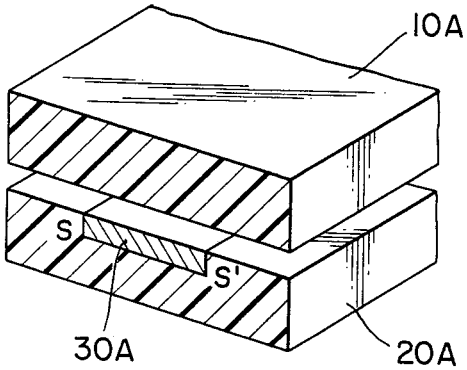
FIG. 4
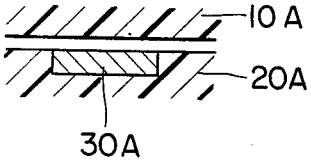
FIG. 4a
FIG. 5
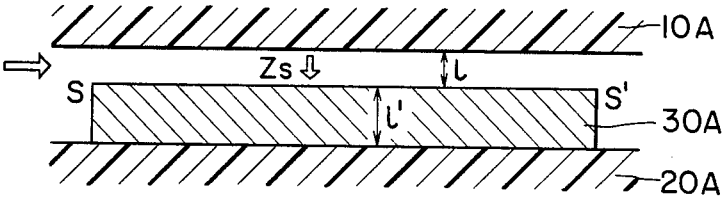
FIG. 6
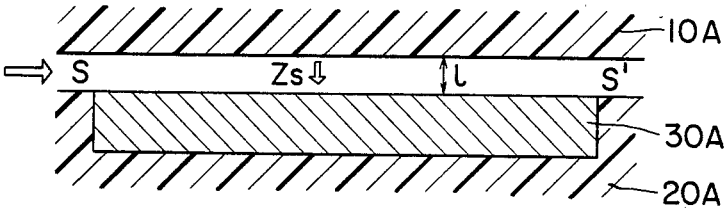

FIG. 7
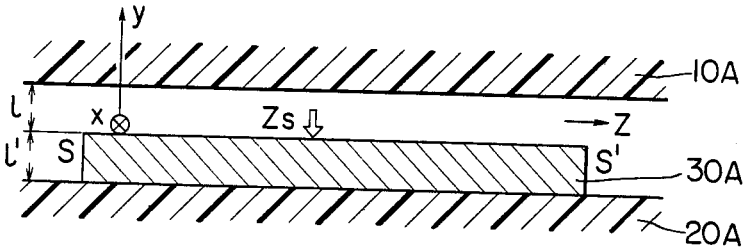
FIG. 8
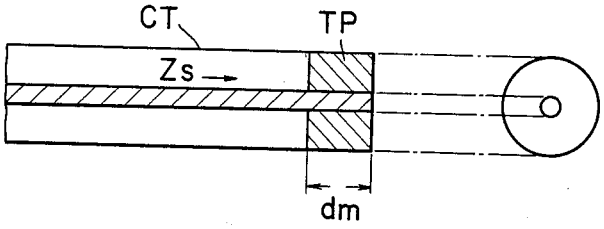
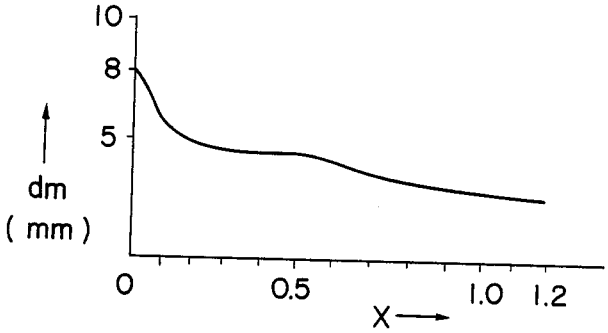
FIG. 9
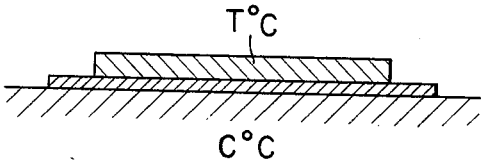
FIG. 10
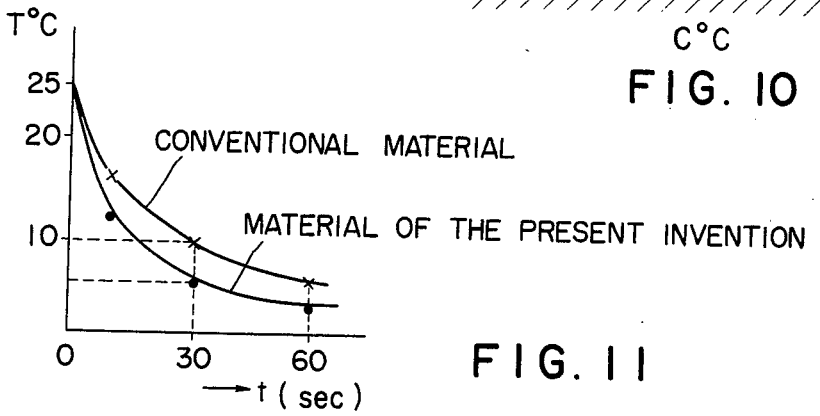
FIG. 11

DEVICE FOR PREVENTING ELECTROMAGNETIC WAVE LEAKAGE FOR USE IN MICROWAVE HEATING APPARATUS

BACKGROUND OF THE INVENTION

The present invention relates to a device for preventing electromagnetic wave leakage, and more particularly to a device for preventing electromagnetic wave leakage in a microwave heating apparatus.

In microwave heating apparatus widely used, which are called "microwave heating oven", it is important to take suitable measures against microwave leakage from gaps between the apparatus body and a door because of two major reasons stated below. First is that the leakage of electromagnetic wave has harmful effect on the human body. Second is that there occur interferences or noises due to a large number of sub and/or higher harmonics included in the microwave in electronic equipment, e.g., radio and/or television receivers or computers etc.

With the above in view, there have been adopted the following four methods for preventing unnecessary radiation in the prior art. First method is to insert a metallic spring between gaps between the apparatus body and the door. Second method is to insert a conductive rubber therebetween in place of the metallic spring employed in the first method. Third method is provided between the apparatus body and the door an absorber formed by mixing ferrite absorber or ferrite powdered material into rubber or plastics. Fourth method is to form the absorber employed in the third method by mixing material having high dielectric constant into rubber or plastics, or by further mixing ferrite powdered material thereinto.

However, these conventional methods have the following drawbacks, respectively. The drawbacks with the first method is that wear or distortion is likely to occur in the spring portion, and that its effect is remarkably injured when an extraneous substance is put between the door and the apparatus body. The drawback with the second method is that there occurs deterioration or distortion produced when the conductive rubber is influenced by heat, and that its effect is greatly reduced when an extraneous substance is put between the door and the apparatus body. On the other hand, the third and fourth methods can exhibit expected effect in a sense, but are not practically acceptable because satisfactory heat-resisting properties of rubber or plastics cannot be obtained, and because a great deal of absorption materials are required for realizing a sufficient leakage preventing effect, resulting in high cost.

SUMMARY OF THE INVENTION

With the above in mind, the present invention has been made and has an object to provide an unnecessary radiation preventing device for use in microwave heating ovens which can effectively prevent microwave leakage, which has a good heat-resisting property and which can be fabricated at a low cost.

To achieve this object, there is provided a device for preventing electromagnetic wave leakage for use in a microwave heating oven wherein ferrite powder, carbon powder and a binder such as rubber or organic high molecular compound etc. are mixed in the predetermined ratios to form an electromagnetic wave absorber, interposing the electromagnetic wave absorber between the apparatus body and the door. As a result of actual measurement, it has been confirmed that the electromagnetic wave absorber thus formed exhibits excellent microwave absorption characteristic and heat-resisting property and is fabricated at a low cost.

BRIEF DESCRIPTION OF THE DRAWINGS

FIGS. 3 and 3*a* are a perspective view and a cross sectional view illustrating a simplified model of the arrangement shown in FIG. 2*a*, respectively, FIGS. 4 and 4*a* are a perspective view and a cross sectional view illustrating a simplified model of the arrangement shown in FIG. 2*b*, respectively, FIGS. 5 and 6 are cross sectional views illustrating, in an enlarged manner, the corresponding parts shown in FIGS. 3*a* and 4*a*, respectively, FIG. 7 is cross sectional view for explaining how various of constants are set in connection with the model shown in FIG. 5, FIG. 8 is schematic view for explaining a method of measuring impedance of the electromagnetic wave absorber, FIG. 9 is showing the relationship between a ratio or carbon mixed into the electromagnetic wave absorber and a thickness required for obtaining a predetermined electromagnetic wave absorption effect, FIG. 10, is an explanatory view showing thermal conductivity of the electromagnetic wave absorber, and FIG. 11 is characteristic curve showing the result obtained with the measurement shown in FIG. 10.

DETAILED DESCRIPTION OF THE PREFERRED EMBODIMENTS

Preferred embodiments according to the present invention will be described with reference to attached drawings.

Figure 1:
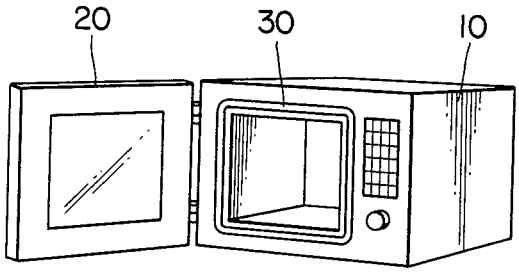
FIG. 1 perspective view illustrating a microwave heating oven provided on its opening end with an electromagnetic absorber

FIG. 1 is a perspective view schematically a microwave heating oven to which the present invention is applied. Microwave heating oven comprises a microwave heating oven body 10, a door 20 hingedly connected to the body 10, and an electromagnetic wave absorber 30 interposed between the body 10 and the door 20. In FIG. 1, the electromagnetic wave absorber 30 is attached on an opening end surface of the body 10. However, the electromagnetic wave absorber 30 may be instead provided on a predetermined position of the door 20 which corresponds to the opening end surface of the body 10. In the case of the microwave heating oven, the electromagnetic wave leaks solely from gaps as leakage paths formed between the body 10 and the door 20. Accordingly, if leakage from these gap portions can be prevented, there is no possibility that the electromagnetic wave leaks out of other portions.

Figure 2A:
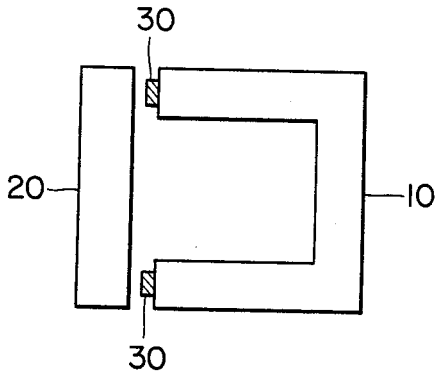
FIGS. 2*a* and 2*b* are plan views schematically illustrating arrangement of the microwave heating oven body, the door and the electromagnetic wave absorber, respectively.
Figure 2B:
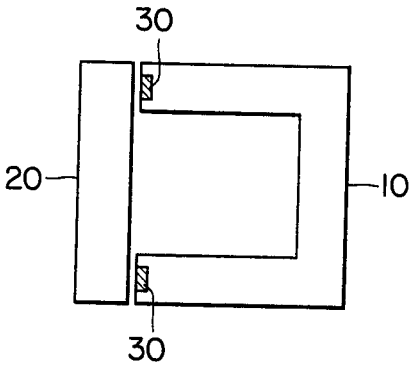

FIGS. 2*a* and 2*b* are plan views illustrating how the microwave heating oven body 10, the door 20 and the electromagnetic wave absorber 30 are arranged, respectively, wherein the absorber 30 is attached on the opening end surface of the body 10 in the arrangement shown in FIG. 2*a*, whereas the absorber 30 is embedded into the opening end surface of the body 10 in the arrangement shown in FIG. 2*b*. The former arrangement is characterized in that the fixing work is simple, whereas the latter arrangement is characterized in that better leakage preventing function can be expected.

FIG. 3 is a perspective view showing a simplified model of the arrangement of the apparatus body 10, the door 20 and the electromagnetic wave absorber 30 shown in FIG. *2a* for illustrative purpose, and FIG. *3a* shows a lateral cross section of the part corresponding to the arrangement shown in FIG. *3a*. In these figures, metallic members constituting the apparatus body 10 and the door 20 are designated by corresponding reference numerals 10A and 20A, respectively, and the electromagnetic absorber is also designated by corresponding reference numeral 30A.

FIG. 4 is a perspective view showing a simplified model of the arrangement shown in FIG. *2b* for illustrative purpose in a manner similar to FIG. 3, and FIG. *4a* shows a lateral cross section of the part corresponding to the arrangement shown in FIG. 4. In this model, the electromagnetic absorber 30A is embedded so that its exposure surface is flush with the surface of the metallic member 20A.

FIGS. 5 and 6 are cross sections illustrating the corresponding parts shown in FIGS. *3a* and *4a* in an enlarged manner, respectively. In the models shown in these figures, it is possible to recognize the behavior of the electromagnetic wave leakage by making an analysis described below using surface impedance Zs when viewing the lower portions in FIGS. 5 and 6 from the upper surfaces therein, i.e., surfaces SS'. That is, how the electromagnetic wave travels in a space between the metallic member 10A and the absorber 30A is analyzed wherein the spacing distance between the metallic member 10A and the surface of the absorber 30A having the surface . impedance Zs is denoted by l. The lateral directions in FIGS. 5 and 6 are corresponding to the propagation directions of the electromagnetic wave, respectively. If the electromagnetic wave travels along the propagation direction to attenuate to a great extent, it is expected that the electromagnetic wave does not leak even if there exist the gap l.

FIG. 7 is a cross section showing various kinds of conditions set for examining the electromagnetic leakage in connection with the model shown in FIG. 5. There is arranged the absorber 30A having a thickness l'0 between the metallic members 10A and 20A in a manner one side surface of the absorber 30A is in contact with the metallic member 20A. The gap between the other side surface of the absorber 30A and the metallic member 10A corresponds to the distance l.

In FIG. 7, assuming that a direction perpendicular to the paper denotes X direction, a longitudinal direction of the paper Y direction, a lateral direction of the paper Z direction, propagation constant in the Y direction $\gamma$, propagation constant in the Z direction $\Gamma$, and wave number in a free space K, electric fields Ez and Ey are expressed by $$Ez = \Sigma o \sin h\gamma(l-y)e^{-\Gamma z} \quad (1)$$

$$Ey = -(\Gamma z/\gamma)Eo \cos h\gamma(l-y)e^{-\Gamma z} \quad (2).$$

Further, assuming that wave impedance in a free space is denoted by $$\eta o = \sqrt{\frac{\mu o}{\epsilon o}}$$

where $\epsilon o$ and $\mu o$ denote dielectric constant in a free space and permeability in a free space, respectively, the magnetic field Hx is expressed by $$\eta oHx = j(k/\gamma)Eo \cos h\gamma(l-y)e^{-\Gamma z} \quad (3).$$

From the magnetic field Hx and the electric field Ez expressed by the above-mentioned equation (1), the surface impedance Zs is expressed by $$Zs = |Ez/(-Hx)|y = o = j\eta_o(\gamma/k)\tan h\gamma l. \quad (4)$$

By substituting $\gamma l$ with W in this equation (4) and arranging it, $$KlZs/\eta o = jW \tan hW \quad (5).$$

By obtaining W in the equation (5), the behavior of the attenuation in the Z direction can be seen from the expression described below, $$\Gamma l = j\sqrt{(kl)^2 + W^2}. \quad (6)$$

The present invention is applicable to various electromagnetic wave propagation path models. For instance, in the case of the model shown in FIG. 7, solution can be obtained using surface impedance viewed from the surface SS' as expressed by the above-mentioned equations (1) to (6).

In accordance with the conventional analytical approaches, analysis of the model shown in FIGS. 5 and 6 is made on the assumption that plane wave travels ih the Z direction as shown in U.S. Pat. No. 4,046,983. However, it cannot be said that this approach correctly grasp the behavior of the electric and magnetic fields.

In contrast, in accordance with the analytical approach based on the surface impedance according to the present invention, the model is grasped as surface wave attenuating in Z direction, thus making it possible to obtain various factors in respect of components including the absorber 30A shown in FIG. 7 using the above-mentioned equations (5) and (6). Namely, because K denotes wave number corresponding to the microwave frequency of 2450 MHz used in the electronic range and l indicates gap distance, both factors can be estimated as constant values. Thus, by determining the surface impedance Zs, W is evaluated from the equation (5) and $\Gamma$ is also evaluated from the equation (6).

Assuming now that relative permittivity, the relative permeability, and the thickness in Y direction of the absorber 30A shown in FIG. 7 are symboled by $\epsilon(=\epsilon'-j\epsilon'')$, $\mu(=\mu'-j\mu'')$, and l', respectively, the value of the surface impedance Zs is evaluated as follows:

$$Zs = \sqrt{\frac{\mu o}{\epsilon o}}\sqrt{\frac{\mu' - j\mu''}{\epsilon' - j\epsilon''}}\tan hjk = \sqrt{(\mu' - j\mu'')(\epsilon' - J\epsilon'')l'}. \quad (7)$$

Then, study is made to know what kinds of materials can allow the thickness l' to be minimized in order to make the surface impedance Zs constant. The reason why such a study is made is that the thinner the thickness l' is, the smaller the amount of the absorber is.

FIG. 8 is a schematic view for explaining a method of measuring surface impedance Zs wherein a sample TP is inserted into a coaxial line CT to measure normalized impedance.

As the material of such a sample, there have been known in the art a mixture of rubber into which only ferrite powder is mixed, but such mixture is not practically acceptable for the reason stated above. In view of this, a study is made as to whether good characteristics can be obtained by further adding carbon powder to the above-mentioned mixture.

The sample comprising MnZnFe-ferrite powder and having a permeability of 2700, carbon powder, and rubber which are mixed in the ratios of 3:X:1 by weight was used. By varying mixture ratio X of the carbon powder, thickness required for allowing surface impedance Zs to be equal to $\eta o$ is measured.

FIG. 9 shows measured results in the above-mentioned case wherein abscissa and ordinate denote mixture ratio X and thickness dm (mm), respectively. From the characteristic curve, it is seen that the required thickness dm decreases from X=0 (dm is nearly equal to 8 mm) to X=1.2 (dm is nearly equal to 2.4 m) according as the mixture ratio X of the carbon powder increases.

In the case of the material which does not contain carbon powder as employed in the prior art, its characteristic corresponds to the case X=0 because carbon powder is not included. Accordingly, in order that the surface impedance Zs is equal to $\eta o$, the thickness of 8 mm is required. In contrast, in accordance with the present invention, when the mixture ratio X is equal to 1.2, the thickness is reduced to 2.4 mm. Namely, by allowing the mixture ratio X to be equal to 1.2, the required thickness can be reduced to approximately one-third of the thickness of the material employed in the prior art. Since the material loss of the MnZnFe-ferrite powder is too large in the range where the mixture ratio X is more than 1.2, it is impossible to allow the surface impedance Zs to be equal to $\eta o$. However, when there is employed a sample comprising MnZnFe-ferrite powder and having a permeability of the order of 5000, carbon powder and rubber which are mixed in the ratios of 2:X:1, it is possible to allow the surface impedance Zs to be equal to $\eta o$ when the mixture ratio falls within X=2. Further, when there is employed a sample comprising MnCuZn-ferrite powder and having a permeability of the order of 200, carbon powder and rubber which are mixed in the ratios of 4:X:1, it is possible to allow the surface impedance Zs to be equal to $\eta o$ when the mixture ratio falls within X=1.

Accordingly, the mixture of ferrite powder, carbon powder and rubber can provide the same effect as the conventional material obtained by mixing only ferrite powder into rubber, and can be produced at a lower cost as compared to the latter, because the carbon powder is much more cheaper than the ferrite powder.

Another feature of the material comprising ferrite powder, carbon powder and rubber employed in the present invention is that thermal conductivity is high.

Referring to FIG. 10, there is shown an arrangement for measuring the thermal conductivity. With this measuring arrangement, measurement is made to examine how temperature at the material surface which is considered as room temperature at an initial stage varies as a function of time from a time at which the temperature at one side surface of the material is set at 0° C.

As understood from FIG. 11 showing the measured results, when the conventional material is employed, the temperature of the material can only lower to about 10° C. when thirty seconds elapse from the beginning, while when the material of the invention is employed, the temperature thereof can lower to about 6° C. Similar tendency can be obtained regardless of the fact that the time lapse is short or long.

From this experiment, it is understood that the material employed in the present invention can allow heat produced due to absorption of leakage electromagnetic wave to immediately escape toward the apparatus body. For this reason, it is preferable that the electromagnetic wave absorber using the material of the invention is provided in a manner to be contact with a metallic housing of the apparatus body.

It is to be noted that the present invention may employ organic high molecular compound instead of rubber employed in the above-mentioned embodiment.

As stated above, the electromagnetic wave leakage preventing device for use in the microwave heating oven according to the present invention is configured such that electromagnetic wave absorber comprising ferrite powder, carbon powder and binder which are mixed in the predetermined ratio is provided between the apparatus body and the door, thus providing the equivalent electromagnetic absorption effect with the thickness being one third of the thickness of the conventional absorber, and good temperature characteristic, and making it possible to produce it at a low cost.

What is claimed is:

1. A device for preventing electromagnetic wave leakage for use in a microwave heating apparatus comprising:

(a) a microwave heating apparatus body provided with a door, and (b) an electromagnetic wave absorber disposed between said apparatus body and said door, said absorber consisting of a mixture obtained by mixing ferrite powder, carbon powder and a high polymer in the ratio of p:q:1 by weight where p is a value ranging from 2 to 4 and q is a value ranging from 0.5 to 2.

2. A device as set forth in claim 1, wherein said electromagnetic wave absorber consists of a mixture obtained by mixing MnZnFe-ferrite powder and having a permeability of approximately 2700, carbon powder and high polymer in the ratio of 3:X:1 by weight where X is a value ranging from 0.5 to 1.2.

3. A device as set forth in claim 1, wherein said electromagnetic wave absorber consists of a mixture obtained by mixing MnZnFe-ferrite powder and having a permeability of approximately 5000, carbon powder and high polymer in the ratio of 2:2:1 by weight.

4. A device as set forth in claim 1, wherein said electromagnetic absorber consists of a mixture obtained by mixing MnCuZn-ferrite powder and having a permeability of approximately 200, carbon powder and high polymer ratio of 4:1:1 by weight.

* * * * *